US008394749B2

(12) United States Patent
Aoyama et al.

(10) Patent No.: US 8,394,749 B2
(45) Date of Patent: Mar. 12, 2013

(54) PRESSURE MEDIUM OIL

(75) Inventors: Shoji Aoyama, Chiba (JP); Keizo Murata, Osaka (JP); Hiroshi Nagakawa, Chiba (JP); Tahei Okada, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 243 days.

(21) Appl. No.: 12/093,739

(22) PCT Filed: Oct. 30, 2006

(86) PCT No.: PCT/JP2006/321620

§ 371 (c)(1),
(2), (4) Date: Oct. 20, 2008

(87) PCT Pub. No.: WO2007/058064

PCT Pub. Date: May 24, 2007

(65) Prior Publication Data

US 2009/0071870 A1 Mar. 19, 2009

(30) Foreign Application Priority Data

Nov. 15, 2005 (JP) ..... 2005-330869

(51) Int. Cl.
*C10M 105/04* (2006.01)

(52) U.S. Cl. ..... 508/591; 508/579; 208/18; 208/19; 252/73

(58) Field of Classification Search ..... 508/579, 508/591
See application file for complete search history.

(56) References Cited

U.S. PATENT DOCUMENTS

| | | | | |
|---|---|---|---|---|
| 3,907,924 | A | 9/1975 | Isa et al. | |
| 3,947,507 | A | 3/1976 | Isa et al. | |
| 4,374,282 | A * | 2/1983 | Maldonado et al. | 568/672 |
| 5,431,835 | A * | 7/1995 | Katafuchi et al. | 508/579 |
| 5,858,932 | A * | 1/1999 | Dasai et al. | 508/371 |
| 6,071,863 | A * | 6/2000 | Benda et al. | 508/591 |
| 6,193,906 | B1 * | 2/2001 | Kaneko et al. | 252/68 |
| 6,759,373 | B2 * | 7/2004 | Tazaki | 508/462 |
| 7,737,095 | B2 * | 6/2010 | Shiraishi et al. | 508/579 |
| 2004/0224860 | A1 | 11/2004 | Baba et al. | |

FOREIGN PATENT DOCUMENTS

| | | |
|---|---|---|
| EP | 1 416 033 A1 | 5/2004 |
| JP | 49 113070 | 10/1974 |
| JP | 49 113889 | 10/1974 |
| JP | 2000 119672 | 4/2000 |
| JP | 2004 182931 | 7/2004 |
| JP | 2004 250504 | 9/2004 |
| JP | 2005 154760 | 6/2005 |
| WO | 2006 073198 | 7/2006 |

OTHER PUBLICATIONS

Keiichi Yokogawa, et al., "Solidification of High-Pressure Medium Daphne 7373", Japanese Journal of Applied Physics, XP007911181, vol. 46, No. 6A, 2007, pp. 3636-3639.

H. Ernest Henderson, "Fischer-Tropsch Gas to Liquids Base Stocks—Performance Beyond Current Synthetics", International Journal of Hydrocarbon Engineering, XP009128262, vol. 7, Aug. 1, 2002, pp. 13-14, 16 and 18.

Keizo Murata, et al., "Pt resistor thermometry and pressure caliberation in a clamped pressure cell with the medium, Daphne 7373", Review of Scientific Instruments, XP009128153, vol. 68, No. 6, Jun. 1, 1997, pp. 2490-2493.

Andrieux, S. et al., "Fluctuation conductivity in 1-D conductor tetrathiafulvalene-tetracyanoquinodimethane ( TTF-TCNQ) (*)", Le Journal De Physique-Letters, Tome 40, No. 15, pp. L-385-L-389, (1979).

Murata, Keizo et al., "Pressure Phase Diagram of the Organic Superconductor β-(BEDT-TTF)$_2$I$_3$", Journal of the Physical Society of Japan, Letters, vol. 54, No. 6, pp. 2084-2087, (1985).

Ronald L. Shubkin, "Polyalphaolefins", CRC Handbook of Lubrication and Tribology vol. III Monitoring, Materials, Synthetic Lubricants, and Applications, XP009108705, Jan. 1, 1993, vol. III, 19 Pages.

* cited by examiner

*Primary Examiner* — Ellen McAvoy
(74) *Attorney, Agent, or Firm* — Oblon, Spivak, McClelland, Maier & Neustadt, L.L.P.

(57) ABSTRACT

The present invention provides a pressure-medium oil comprising at least one of a hydrocarbon compound and an ether compound and having the following properties (1) to (4):

(1) a kinematic viscosity as measured at 40° C. of 2 to 30 mm$^2$/s;
(2) a viscosity index of 110 or higher;
(3) a density as measured at 15° C. of 0.86 g/cm$^3$ or less; and
(4) a pour point of −50° C. or lower. The pressure-medium oil does not solidify under an ultra-high pressure, for example, 1.5 GPa or higher, and has a low pour point and excellent compatibility with test samples and with the material of the apparatus employed in the test.

24 Claims, No Drawings

PRESSURE MEDIUM OIL

This application is a 371 of PCT/JP2006/321620, filed Oct. 30, 2006.

TECHNICAL FIELD

The present invention relates to a pressure-medium oil and more particularly to a pressure-medium oil which has a high solidifying pressure and which can be used under ultra-high pressure.

BACKGROUND ART

Studies to find out new functions of a substance through application of ultra-high pressure thereto have been widely carried out around the world.

In the studies of organic conductors, an organic superconductor $(TMFSF)_2PF_6$ was identified on the basis of studies on the pressure-dependency of metal-nonmetal transition, and an 8K superconductor $\beta$-$(BEDT\text{-}TTF)_2I_3$ was identified through studies on the pressure-dependency of characteristics of the substance (see Non-Patent Documents 1 and 2).

Thus, development of substances having new properties has been carried out through investigation of changes in physical properties of solid substances, including organic superconductors and oxide conductors, under varied temperature (ultra-low temperature), magnetic field, etc. as well as varied pressure.

In the studies conducted under variation of pressure, ultra-high pressure is generally applied to a target substance by the mediation of a pressure medium, particularly a liquid pressure medium, since a required pressure must be applied isostatically and gradually to the target substance. Such pressure application can be attained by hydrostatic pressure.

Therefore, a pressure medium must maintain the liquid state in a wide pressure range. If the pressure medium solidifies during pressure application, the target is pressed uniaxially, failing to attain isostatic pressing. In other words, a pressure medium is required to have, among other properties, high solidifying pressure at room temperature. Meanwhile, since the aforementioned studies are often carried out at ultra-low temperatures, a pressure medium must also have a low pour point. Needless to say, a pressure medium must be compatible in terms of material with test samples and with apparatus employed in the test.

Meanwhile, there have been known, as a pressure medium which is liquid at ambient temperature and is for use under ultra-high pressure, hydrocarbons such as specific petroleum fractions (e.g., naphthene-based mineral oil) and isopentane; and alcohol-based media such as methanol-ethanol mixture and water-glycol mixture. However, these conventional media are not satisfactory. Specifically, naphthene-based mineral oil and isopentane have low solidifying pressure; methanol-ethanol mixture is not preferred in that it dissolves an electrical resistance terminal (conductive paste) attached to a measurement sample and other parts, although the solidifying pressure is high; and water-glycol mixture has low solidifying pressure.

Therefore, there is demand for the development of a pressure medium which has high solidifying pressure at room temperature and which is compatible in terms of material with test samples and with apparatus employed in the test.

Non-Patent Document 1: Journal of Physical Letter, vol. 40, L-385 (1979)

Non-Patent Document 2: Journal of Physical Society Jpn., vol. 54, (1985) 2084

DISCLOSURE OF THE INVENTION

Problems to be Solved by the Invention

The present invention has been accomplished under such circumstances. Thus, an object of the present invention is to provide a pressure-medium oil which is not solidified under ultra-high pressure (e.g., $\geqq$1.5 GPa), which has a low pour point, and which is highly compatible in terms of material with test samples and with apparatus employed in the test.

Means for Solving the Problems

The present inventors have found that a hydrocarbon compound and an ether compound having specific characteristics are not readily solidified even under ultra-high pressure. The present invention has been accomplished on the basis of this finding.

Accordingly, the present invention provides the following.

1. A pressure-medium oil comprising at least one of a hydrocarbon compound and an ether compound and having the following properties (1) to (4):

(1) a kinematic viscosity as measured at 40° C. of 2 to 30 $mm^2/s$;

(2) a viscosity index of 110 or higher;

(3) a density as measured at 15° C. of 0.86 $g/cm^3$ or less; and (4) a pour point of −50° C. or lower.

2. A pressure-medium oil as described in 1 above, which has a kinematic viscosity as measured at 40° C. of 2 to 15 $mm^2/s$.

3. A pressure-medium oil as described in 1 or 2 above, wherein the hydrocarbon compound is an oligomer of a C6 to C14 1-olefin or a hydrogenated product of the oligomer.

4. A pressure-medium oil as described in 1 or 2 above, wherein the ether compound is represented by formula (1):

$$R^1—O—(R^3—O)_m—R^2 \quad (1)$$

(wherein each of $R^1$ and $R^2$ represents a C2 to C10 monovalent hydrocarbon group; $R^3$ represents a C2 to C10 divalent hydrocarbon group; m is an integer of 1 to 3; and the compound has 10 to 30 carbon atoms in total and two or more branched chains).

5. A pressure-medium oil as described in any of 1 to 4 above, which has a solidifying pressure as measured at room temperature (25° C.) of 2.3 GPa or higher,

Effects of the Invention

The pressure-medium oil according to the present invention does not solidify at room temperature (25° C.) under an ultra-high pressure of 1.5 GPa or higher, and has a low pour point and excellent compatibility with test samples and with the material of the apparatus employed in the test. Therefore, when the pressure-medium oil is employed in an ultra-high pressure generator and an ultra-high pressure of 1.5 GPa or higher, particularly 2.3 GPa or higher, is applied to a sample, the pressure can be isostatically applied to the sample, while ensuring excellent compatibility with the test sample and with the material of the apparatus employed in the test.

BEST MODES FOR CARRYING OUT THE INVENTION

The pressure-medium oil according to the present invention contains at least one of a hydrocarbon compound and an ether compound and has the following properties (1) to (4).

(1) The pressure-medium oil of the present invention has a kinematic viscosity as measured at 40° C. of 2 to 30 $mm^2/s$, preferably 2 to 15 $mm^2/s$. When the pressure-medium oil has a kinematic viscosity as measured at 40° C. less than 2 $mm^2/s$, evaporation loss and flashing of the pressure-medium oil may occur, whereas when the kinematic viscosity as measured at 40° C. is in excess of 30 $mm^2/s$, the solidifying pressure of the pressure-medium oil may decrease. Both cases are not preferred.

(2) The pressure-medium oil of the present invention has a viscosity index of 110 or higher, preferably 120 or higher, particularly preferably 125 or higher. When the viscosity index is lower than 110, solidifying pressure may decrease, which is not preferred.

(3) The pressure-medium oil of the present invention has a density as measured at 15° C. of 0.86 $g/cm^3$ or less. When the density as measured at 15° C. is in excess of 0.86 $g/cm^3$, solidifying pressure decreases. Therefore, the density as measured at 15° C. is preferably 0.85 $g/cm^3$ or less, with 0.78 to 0.83 $g/cm^3$ being particularly preferred.

(4) The pressure-medium oil of the present invention has a pour point of −50° C. or lower. When the pour point is higher than −50° C., solidifying pressure decreases, and operability in low-temperature experiments is impaired, which is disadvantageous.

The pressure-medium oil according to the present invention contains at least one of a hydrocarbon compound and an ether compound and having the following properties (1) to (4).

The hydrocarbon compound is, for example, an oligomer of a C6 to C14 (preferably C8 to C14) 1-olefin (α-olefin) or a hydrogenated product thereof. Typical examples of the 1-olefin oligomer include 1-octene oligomer, 1-decene oligomer, 1-dodecene oligomer, and hydrogenated products thereof. Among them, 1-decene oligomer and hydrogenated products thereof are particularly preferred.

The ether compound preferably has two or more ether bonds. For example, ether compounds represented by formula (1):

$$R^1—O—(R^3—O)_m—R^2 \quad (1)$$

(wherein each of $R^1$ and $R^2$ represents a C2 to C10 monovalent hydrocarbon group; $R^3$ represents a C2 to C10 divalent hydrocarbon group; m is an integer of 1 to 3; and each of the compounds has 10 to 30 carbon atoms in total and two or more branched chains) may be employed.

In the above formula (1), the C2 to C10 monovalent hydrocarbon group represented by $R^1$ or $R^2$ is preferably a C2 to C01 (more preferably C3 to C10) linear or branched alkyl group. Of these, an alkyl group having one or more branched chains is preferred. The divalent hydrocarbon group in formula (1) represented by $R^3$ is preferably a C2 to C10 (more preferably C3 to C10) linear or branched alkylene group.

Typical examples of the ether compound represented by formula (1) include a diether formed from octanediol and trimethylhexanol, a diether formed from trimethylolpropane and 3,7-dimethyloctanol, and a diether formed from tripropylene glycol and decanol.

In the present invention, so long as the pressure-medium oil has the aforementioned properties (1) to (4), the hydrocarbon compound and the ether compound may be used singly or in combination of two or more species. When the hydrocarbon compound and the ether compound are used in combination, the ratio of hydrocarbon compound to ether compound may be selected as desired.

Into the pressure-medium oil according to the present invention, a known additive can be incorporated, so long as the object of the invention can be attained. Examples of such additives include detergent dispersants such as succinimide and boro-succinimde; antioxidants such as phenolic antioxidants and amine antioxidants; anticorrosive agents such as benzotriazole anticorrosives and thiazole anticorrosives; anti-rusting agents such as metal sulfonate anti-rusting agents and succinate ester anti-rusting agents; defoaming agents such as silicone defoaming agents and fluorosilicone defoaming agents; and viscosity index improvers such as polymethacrylates improvers and olefin copolymer improvers. These additives may be added as desired in such amounts that target properties can be attained. Generally, the total amount of the additives is 10 mass % or less with respect to the composition.

EXAMPLES

The present invention will next be described in more detail by way of the Examples and Comparative Examples, which should not be construed as limiting the invention thereto. The performance of each pressure-medium oil was determined through the following procedure.

Determination of Solidifying Pressure of Pressure-medium Oil

A pressure-medium oil sample was added to a cylindrical pressure vessel maintained at room temperature (25° C.), and the oil was vertically compressed by the application of pressure. Strain in the vertical direction and that in the lateral direction were measured by means of strain gauges placed in the sample. When gauges no longer detected any strain in the lateral direction, the pressure at that point was determined as solidifying pressure. Ammonium fluoride (0.361, 115 GPa) and bismuth (Bi) (2.55, 2.77 GPa) were employed as pressure standards.

Properties of Pressure-Medium Oil

Kinematic viscosity: Determined in accordance with JIS K 2283.

Viscosity index: Determined in accordance with JIS K 2283.

Density: Determined in accordance with JIS K 2249.

Pour point: Determined in accordance with JIS K 2269.

Aniline point: Determined in accordance with JIS K 2256.

Flash point: Determined in accordance with JIS K 2265.

Examples 1 to 4 and Comparative Examples 1 to 3

Solidifying pressure, kinematic viscosity, viscosity index, and other properties of pressure-medium oils composed of the following compounds 1 to 7, respectively, were determined. Table 1 shows the results.

Compound 1: 1-Olefin oligomer-1

Compound 2: 1-Olefin oligomer-2

Compound 3: 1-Olefin oligomer-3

Compound 4: Diether formed from octanediol and trimethylhexanol

Compound 5: Commercial product (fluorinated oil)

Compound 6: Polybutene

Compound 7: Hard alkylbenzene

TABLE 1

| | Items | Ex. 1 Compd. 1 | Ex.2 Compd. 2 | Ex. 3 Compd. 3 | Ex. 4 Compd. 4 | Comp. Ex. 1 Compd. 5 | Comp. Ex. 2 Compd. 6 | Comp. Ex. 3 Compd. 7 |
|---|---|---|---|---|---|---|---|---|
| Properties | Kinematic viscosity (40° C.) $mm^2/s$ | 17.50 | 5.10 | 13.61 | 11.20 | 1.434 | 11.00 | 4.276 |
| | Kinematic viscosity (100° C.) $mm^2/s$ | 3.900 | 1.800 | 3.416 | 3.209 | 0.534 | 2.650 | 1.424 |
| | Viscosity index- | 120 | 128 | 129 | 164 | — | 60 | 28 |
| | Density (15° C.) $g/cm^3$ | 0.819 | 0.798 | 0.815 | 0.847 | — | 0.818 | 0.860 |
| | Pour point ° C. | −60> | −60> | −50> | −60> | — | −60 | −50> |
| | Aniline point ° C. | — | — | 120.8 | 29.6 | — | 104 | — |
| | Flash point ° C. | 222 | 156 | 232 | — | — | 148 | 142 |
| Performance | Solidifying pressure (room temp.: 25° C.) GPa | 2.2 | 2.7 | 2.5 | 1.7 | 1.5 | 0.7 | 0.8 |

As is clear from Table 1, the pressure-medium oils of Examples 1 to 3, composed of 1-olefin oligomer, exhibited high solidifying pressures (at room temperature (25° C.)) of 2.2, 2.7, and 2.5 GPa. Particularly, the pressure-medium oils of Examples 2 and 3, composed of a 1-olefin oligomer having a kinematic viscosity (40° C.) of 15 $mm^2/s$ or lower, exhibit solidifying pressures exceeding 2.5 GPa. The pressure-medium oil of Example 4, composed of a diether, exhibited a high solidifying pressure of 1.7 GPa. In contrast, the pressure-medium oils of Comparative Examples 1 to 3 (commercial product, polybutene, and hard alkylbenzene, respectively) exhibited low solidifying pressures not higher than 1.5 GPa.

Industrial Applicability

The pressure-medium oil according to the present invention does not solidify at room temperature (25° C.) under an ultra-high pressure of 1.5 GPa or higher, and is not reactive with respect to a variety of substances. Therefore, when the pressure-medium oil is employed in an ultra-high pressure generator and an ultra-high pressure higher than 1.5 GPa, particularly higher than 2.0 GPa, more particularly higher than 2.5 GPa, is applied to a sample, the pressure can be isostatically applied to the sample, while ensuring excellent compatibility with the test sample and with the material of the apparatus employed in the test. Thus, the pressure-medium oil can be employed in a variety of experiments under ultra-high pressure and in ultra-high pressure apparatus.

The invention claimed is:

1. A method of adding a pressure-medium oil to a high pressure generator, wherein said pressure-medium oil consists essentially of at least one hydrocarbon compound which is an oligomer of a C6 to C14 1-olefin or a hydrogenated product of the oligomer, wherein said pressure-medium oil has the following properties (1) to (4):

(1) a kinematic viscosity as measured at 40° C. of 2 to 30 $mm^2/s$;

(2) a viscosity index of 110 or higher;

(3) a density as measured at 15° C. of 0.86 $g/cm^3$ or less; and (4) a pour point of −50° C. or lower.

2. The method of claim 1, wherein said pressure-medium oil has a kinematic viscosity as measured at 40° C. of 2 to 15 $mm^2/s$.

3. The method of claim 1, wherein the pressure-medium oil has a solidifying pressure as measured at room temperature (25° C.) of 2.3GPa or higher.

4. The method of claim 1, wherein the pressure-medium oil has a solidifying pressure as measured at room temperature (25° C.) of 1.5GPa or higher.

5. The method of claim 1, wherein the pressure-medium oil has a viscosity index of 120 or higher and a density as measured at 15° C. of 0.78 to 0.83 $g/cm^3$.

6. The method of claim 1, wherein the pressure-medium oil has a viscosity index of 125 or higher and a density as measured at 15° C. of 0.78 to 0.83 $g/cm^3$.

7. The method of claim 1, wherein the pressure-medium oil consists essentially of at least one hydrocarbon compound selected from the group consisting of 1-octene oligomer, 1-decene oligomer, 1-dodecene oligomer, hydrogenated products thereof, and mixtures thereof.

8. The method of claim 1, wherein the pressure-medium oil further comprises an ether compound.

9. A method of applying pressure higher than 1,5 GPa to a pressure-medium oil, wherein said pressure medium oil consists essentially of at least one hydrocarbon compound which is an oligomer of a C6 to C14 1-olefin or a hydrogenated product of the oligomer, wherein said pressure-medium oil has the following properties (1) to (4):

(1) a kinematic viscosity as measured at 40° C. of 2 to 30 $mm^2/s$;

(2) a viscosity index of 110 or higher;

(3) a density as measured at 15° C. of 0.86 $g/cm^3$ or less; and (4) a pour point of −50° C. or lower.

10. The method of claim 9, wherein the pressure-medium oil has a kinematic viscosity as measured at 40° C. of 2 to 15 $mm^2/s$.

11. The method of claim 9, wherein the pressure-medium oil has a solidifying pressure as measured at room temperature (25° C.) of 2.3GPa or higher.

12. The method of claim 9, wherein the pressure-medium oil has a solidifying pressure as measured at room temperature (25° C.) of 1.5GPa or higher.

13. The method of claim 9, wherein the pressure-medium oil has a viscosity index of 120 or higher and a density as measured at 15° C. of 0.78 to 0.83 $g/cm^3$.

14. The method of claim 9, wherein the pressure-medium oil has a viscosity index of 125 or higher and a density as measured at 15° C. of 0.78 to 0.83 $g/cm^3$.

15. The method of claim 9, wherein the pressure-medium oil consists essentially of at least one hydrocarbon compound selected from the group consisting of 1-octene oligomer, 1-decene oligomer, 1-dodecene oligomer, hydrogenated products thereof, and mixtures thereof.

16. The method of claim 9, wherein the pressure-medium oil further comprises an ether compound.

17. A method of adding a pressure-medium oil to a high-pressure generator, said pressure-medium oil consisting essentially of at least one ether compound which is represented by formula (1):

$$R^1—O—(R^3—O)_m—R^2 \quad (1)$$

wherein each of $R^1$ and $R^2$ represents a C2 to C10 monovalent hydrocarbon group; $R^3$ represents a C2 to C10 divalent hydrocarbon group; m is an integer of 1 to 3; and the compound has 10 to 30 carbon atoms in total and two or more branched chains, wherein said pressure-medium oil has the following properties (1) to (4):

(1) a kinematic viscosity as measured at 40° C. of 2 to 30 $mm^2/s$;

(2) a viscosity index of 110 or higher;

(3) a density as measured at 15° C. of 0.86 $g/cm^3$ or less; and (4) a pour point of −50° C. or lower.

18. The method of claim 17, wherein said pressure-medium oil has a solidifying pressure as measured at room temperature (25° C.) of 2.3GPa or higher.

19. The method of claim 17, wherein said pressure-medium oil has a solidifying pressure as measured at room temperature (25° C.) of 1.5GPa or higher.

20. The method of claim 17, wherein said pressure-medium oil consists essentially of at least one ether compound selected from the group consisting of a diether formed from octanediol and trimethylhexanol, a diether formed from trimethylolpropane and 3,7-dimethyloctanol, a diether formed from tripropylene glycol and decanol, and mixtures thereof.

21. A method of applying pressure higher than 1,5 GPa to a pressure-medium oil, said pressure-medium oil consisting essentially of at least one ether compound which is represented by formula (1):

$$R^1—O—(R^3—O)_m—R^2 \quad (1)$$

wherein each of $R^1$ and $R^2$ represents a C2 to C10 monovalent hydrocarbon group; $R^3$ represents a C2 to C10 divalent hydrocarbon group; m is an integer of 1 to 3; and the compound has 10 to 30 carbon atoms in total and two or more branched chains, wherein said pressure-medium oil has the following properties (1) to (4):

(1) a kinematic viscosity as measured at 40° C. of 2 to 30 $mm^2/s$;

(2) a viscosity index of 110 or higher;

(3) a density as measured at 15° C. of 0.86 $g/cm^3$ or less; and (4) a pour point of −50° C. or lower.

22. The method of claim 21, wherein said pressure-medium oil has a solidifying pressure as measured at room temperature (25° C.) of 2.3GPa or higher.

23. The method of claim 21, wherein said pressure-medium oil has a solidifying pressure as measured at room temperature (25° C.) of 1.5GPa or higher.

24. The method of claim 21, wherein said pressure-medium oil consists essentially of at least one ether compound selected from the group consisting of a diether formed from octanediol and trimethylhexanol, a diether formed from trimethylolpropane and 3,7-dimethyloctanol, a diether formed from tripropylene glycol and decanol, and mixtures thereof.

* * * * *